US008276686B2

(12) United States Patent
James

(10) Patent No.: US 8,276,686 B2
(45) Date of Patent: Oct. 2, 2012

(54) VACUUM ASSISTED DRILL CUTTINGS DRYER AND HANDLING APPARATUS

(76) Inventor: Michael H James, Lottie, LA (US)

( * ) Notice: Subject to any disclaimer, the term of this patent is extended or adjusted under 35 U.S.C. 154(b) by 0 days.

(21) Appl. No.: 13/049,353

(22) Filed: Mar. 16, 2011

(65) Prior Publication Data

US 2012/0193146 A1 Aug. 2, 2012

Related U.S. Application Data

(60) Provisional application No. 61/437,481, filed on Jan. 28, 2011.

(51) Int. Cl.
*E21B 21/06* (2006.01)

(52) U.S. Cl. ..... 175/66; 175/206; 175/207

(58) Field of Classification Search ..... 175/66, 175/206, 207

See application file for complete search history.

(56) References Cited

U.S. PATENT DOCUMENTS

| | | | | |
|---|---|---|---|---|
| 6,009,959 | A | 1/2000 | Dietzen | |
| 6,170,580 | B1 | 1/2001 | Reddoch | |
| 6,213,227 | B1 * | 4/2001 | Dietzen | 175/66 |
| 7,195,084 | B2 | 3/2007 | Burnett et al. | |
| 7,380,617 | B1 * | 6/2008 | James | 175/66 |
| 7,753,126 | B2 | 7/2010 | Reddoch, Sr. | |
| 2005/0074302 | A1 | 4/2005 | Burnett et al. | |
| 2011/0036633 | A1 * | 2/2011 | Reddoch | 175/66 |

FOREIGN PATENT DOCUMENTS

| | | |
|---|---|---|
| GB | 2339443 | 1/2000 |
| GB | 2376037 | 4/2002 |
| JP | 2003065276 | 8/2001 |
| WO | 9816717 | 4/1998 |
| WO | 0246571 | 6/2002 |

* cited by examiner

*Primary Examiner* — Cathleen Hutchins

(57) ABSTRACT

A vacuum assisted drill cuttings dryer and handling apparatus has a vacuum tank and an associated vacuum pump and motor configured for use with a high speed centrifugal dryer. Cuttings are drawn from the shaker of a drilling rig into the centrifugal dryer by means of a vacuum created in the centrifugal dryer by the vacuum tank and an associated vacuum pump and motor. The dryer is provided with sealable exit doors that may be opened and closed in sequence to allow removal of the cuttings even as cuttings are drawn in to the centrifugal dryer. A fluids collection chamber in communication with vacuum lines between the vacuum tank and centrifugal dryer collects fluids drawn from the centrifugal dryer.

15 Claims, 2 Drawing Sheets

VACUUM ASSISTED DRILL CUTTINGS DRYER AND HANDLING APPARATUS

This application claims priority to U.S. provisional application Ser. No. 61/437,481 filed Jan. 28, 2011, the entire content of which is hereby incorporated by reference.

FIELD OF INVENTION

This invention relates to the field of oil and gas exploration and, more particularly, relates to a method and apparatus for a drill cuttings dryer and conveyance system to convey, treat, and collect the drill cuttings and liquids associated with the drill cuttings that are produced during the drilling of oil and gas wells.

BACKGROUND OF INVENTION

In the drilling of oil and gas wells, whether offshore or onshore, rotary drilling techniques require the use of drilling mud circulated through the borehole during the drilling process. Typically, the drilling rig is provided with a drilling mud circulation and cuttings collection system. In such a system, the drilling mud is pumped from a mud holding tank, through mud supply lines, down through the borehole and returned to the surface of the borehole. This circulating drilling mud carries the drill cuttings that are produced as the drill bit advances in the borehole to the surface of the well.

The drilling mud and that is returned to the surface, along with the carried drill cuttings, is typically transferred to a shaker or sieving device. The shaker or sieving device is used to remove the carried drill cuttings from the drilling mud. The drilling mud, absent the removed drill cuttings, is then recirculated to the borehole and the drill cuttings that are removed by the shaker are typically collected in drill cuttings collection trough that is in communication with the shaker.

The drill cuttings in the cuttings collection trough are typically comprised of bits of shale, sand, hard clays, or shell that may have been present in the borehole. The drill cuttings are often coated with or contain residual liquids such as drilling mud or other liquids that may have been present in the borehole. The drill cuttings and the residual liquids may contain hazardous environmental contaminants that will require treatment before their ultimate disposal.

These cuttings with these residual liquid contaminants are typically conveyed to a dryer for removal of the residual liquids. The cuttings and any remaining liquids then transferred to storage boxes or containers where they are retained on the rig or at the well site until they are removed for further treatment and disposal at a later time.

Various techniques are currently utilized to convey the drill cuttings and associated residual liquids from the drill cuttings collection trough to a dryer and then to storage boxes or container. These techniques include the use of conveyors, chutes, and vacuum lines.

The present invention is designed to provide a novel drill cuttings dryer and cuttings handling apparatus that utilizes a vacuum suction both to assist and enhance the removal of the associated residual liquids from the drill cuttings and to serve as the conveyance system for the drill cuttings and the associated residual liquids treat during their collection and treatment.

SUMMARY OF INVENTION

The apparatus is comprised of vacuum tank configured for use with an associated a high speed centrifugal dryer. It is thought that the CSI Screen Scroll Centrifuge, CSI Model WSM-03, vertical cuttings dryer would be suitable for use as the centrifugal dryer. The centrifugal dryer has a centrifugal drying chamber, a cuttings inlet suction port to the drying chamber, a vacuum port from the drying chamber, and cuttings exit port from the drying chamber.

The cuttings exit port of the centrifugal dryer is connected to a first cuttings collection chamber by means of an airtight passage way. The cuttings collection chamber has an airtight exit door having a cuttings dump valve to allow cuttings to be removed from the cuttings collection chamber to a cuttings storage box or other desired equipment by gravity. It is thought that the cuttings dump valve will be a manual or automatically operable knife edge gate valve though other types of valves such as a butterfly valve could be utilized.

Drill cuttings are transported to the centrifugal dryer from the cuttings shaker by means of a suction line or multiple cuttings suction lines that extend from the cuttings collection trough at the shaker to the cuttings suction inlet port of the centrifugal dryer. A vacuum in the centrifugal dryer, and thus suction at the suction inlet port and in the cuttings suction lines, is created by means of vacuum lines extending from the vacuum tank to the centrifugal dryer. The vacuum tank has an associated vacuum pump and motor for creating a vacuum in the vacuum tank.

A fluids collection chamber is connected to the vacuum lines between the vacuum tank and the centrifugal dryer. This fluids collection chamber collects the fluids that are drawn into the vacuum lines from the centrifugal drying chamber as the fluids are pulled from the cuttings during drying. The fluids collection chamber has an airtight fluids exit port having a fluids dump valve in communication with a fluids dump or discharge line.

A vacuum control or relief valve is connected to a vacuum control port in the vacuum tank which is used to regulate the vacuum created in the vacuum tank and thus the suction created at the cuttings inlet suction port to the drying chamber of the centrifugal dryer. Pressure monitors may be utilized to transmit signals to a control panel from which control signals may be transmitted to the vacuum control valve to regulate the vacuum created in the vacuum tank.

The control panel may also be used to transmit signals to the cuttings dump valve at the exit door the cuttings collection chamber to regulate removal of cuttings collected in the cuttings collection chamber. Similarly, the control panel may also be used to transmit signals to the fluids dump valve at the fluids drain port of the fluids collection chamber to regulate removal of fluids collected in the fluids collection chamber.

In operation, one end of a suction line is placed in the cuttings trough at the shaker with the other end of the suction line connected to the cuttings suction inlet port of the centrifugal dryer. With the vacuum relief valve, the cuttings dump valve, and the fluids dump valve closed, and the vacuum pump and motor in operation, a vacuum is created in the vacuum tank and thus the centrifugal dryer. Drill cuttings are then drawn from the cuttings trough at the shaker through the suction line and into the centrifugal drying chamber of the centrifugal dryer.

Drill cuttings accumulated in the cuttings hopper are discharged to the solids pump by gravity means and then pumped by the solids pump to a cuttings dryer, to cuttings storage boxes, or to other desired destinations via the cuttings discharge line.

The components of the system may be easily transported to and from a well location by trucking or other means. The components may be arranged and mounted on a skid or skids to facilitate transportation of the system.

DESCRIPTION OF EMBODIMENT

Figure 1:
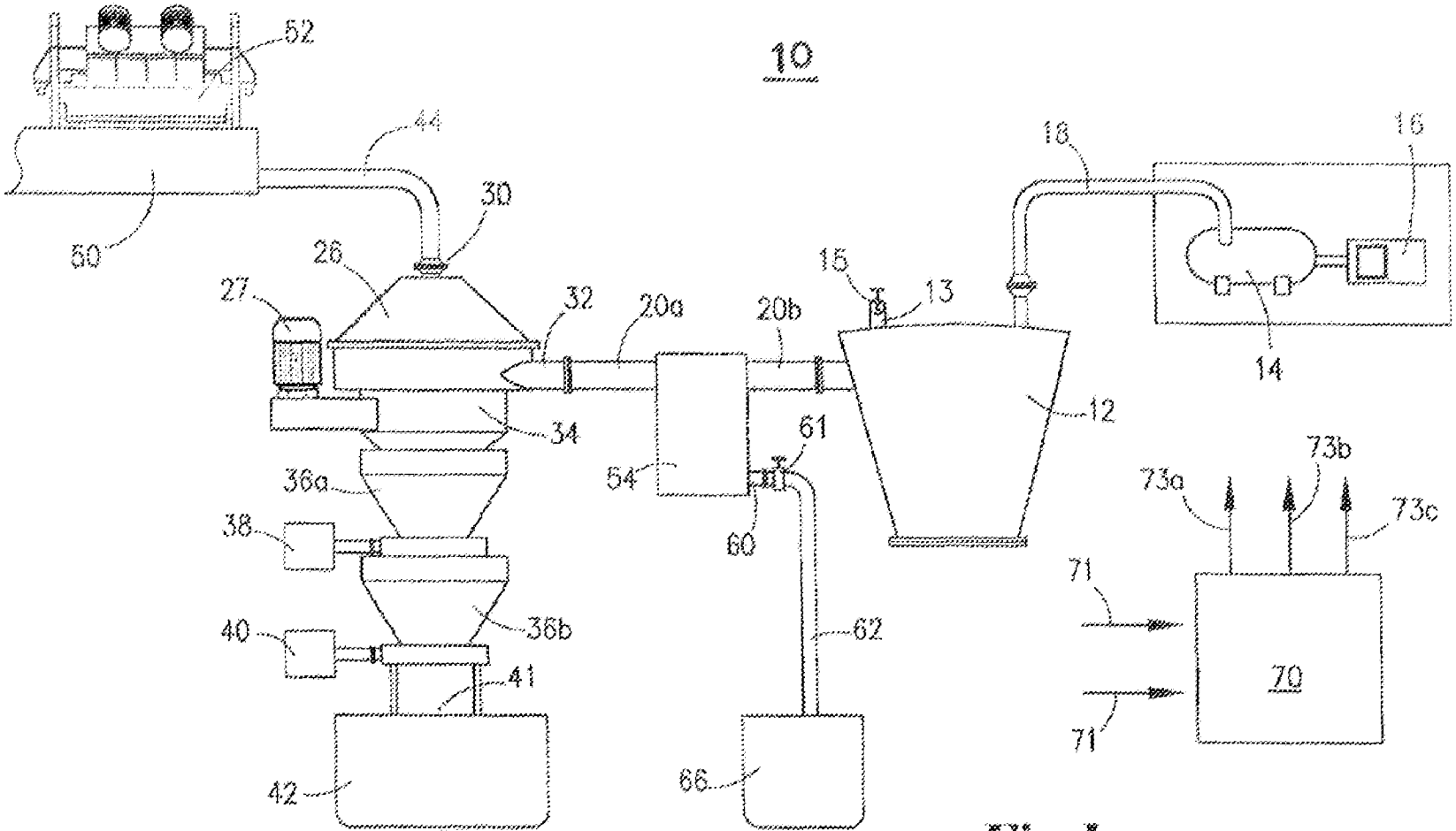
FIG. 1 is a schematic diagram of the vacuum assisted drill cuttings dryer and handling apparatus of applicant's invention.
Figure 2:
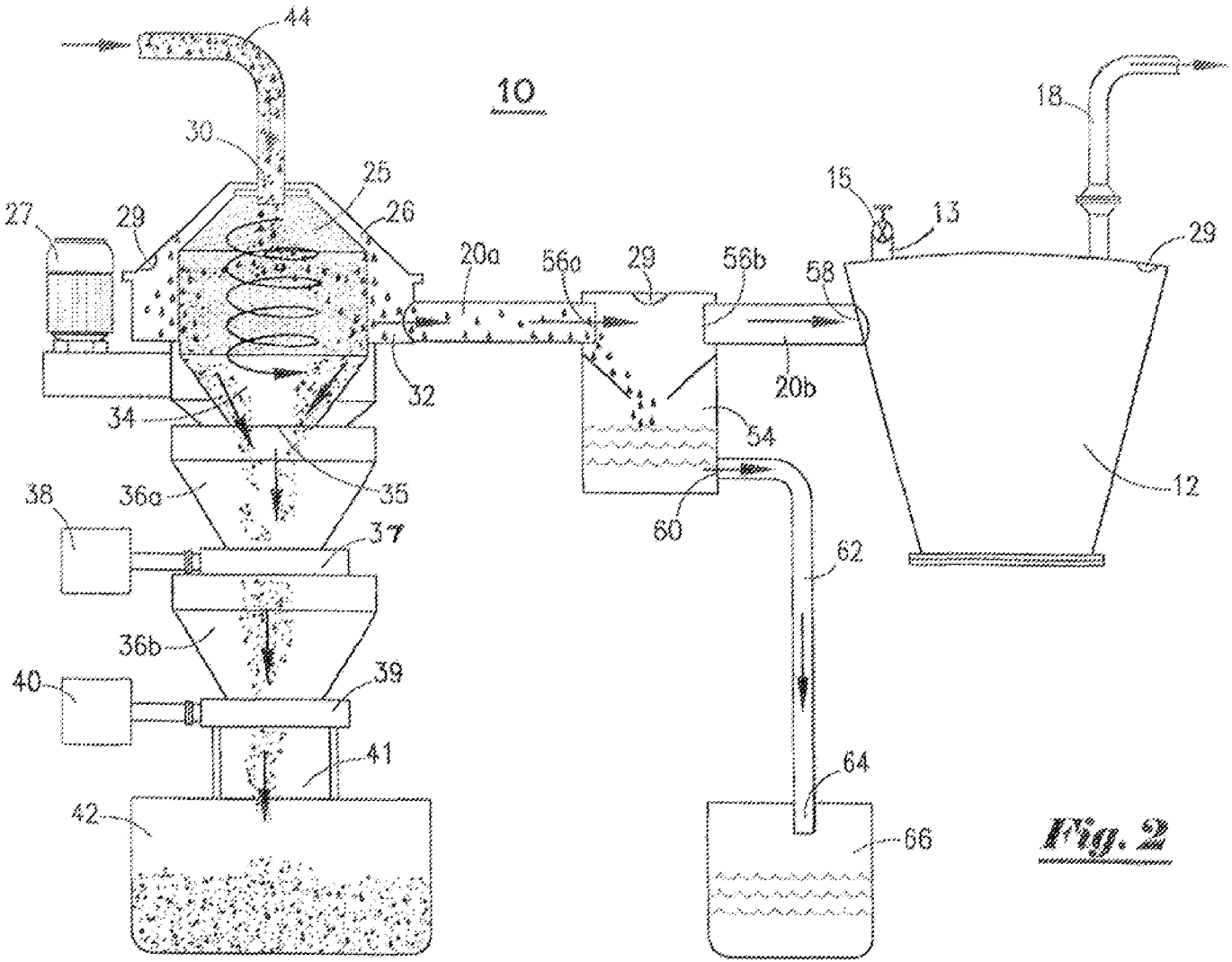
FIG. 2 is a schematic sectional view of the apparatus shown in FIG. 1.

FIG. 1 and FIG. 2 show schematic diagrams of the vacuum assisted drill cuttings dryer and handling apparatus described herein. In these Figures, common features that are well established and do not bear upon points of novelty are omitted in the interest of descriptive clarity. Such omitted features may include threaded junctures, weld lines, sealing elements, flanges, valves, pins and brazed junctures.

Referring now to the drawings, FIG. 1 and FIG. 2, the apparatus (10) is comprised of a vacuum tank (12) and an associated vacuum pump (14) and motor (16) configured for use with a high speed centrifugal dryer (26). It is thought that the CSI Screen Scroll Centrifuge, CSI Model WSM-03, vertical cuttings dryer manufactured by Centrifugal Services, Inc., 5595 Highway 34 North, Raleigh, Ill. 62977, would be suitable for use as the centrifugal dryer (26). The vacuum tank (12), vacuum pump (14) and motor (16) through the associated vacuum lines (18) and (20*a* and 20*b*) are used to place the dryer (26) under a vacuum.

As shown in FIG. 2, the centrifugal dryer (26) has a screened centrifugal drying chamber (25) powered by motor (27). A cuttings inlet suction port (30) is provided into the drying chamber (25) to receive drill cuttings. The centrifugal dryer (26) is provided with a vacuum port (32) for communication with the vacuum line (20*a*) that extends from a fluids collection chamber (54) which is in turn in communication with the vacuum line (20*b*) that extends to the vacuum tank (12). A cuttings exit port (34) is provide in the centrifugal dryer (26) to allow removal of cuttings drawn into the drying chamber (25).

A suction line (44) is provided and placed in communication with a cuttings suction inlet port (30) to the centrifugal dryer (26). The suction line (44) extends from the centrifugal dryer (26) to the cuttings collection trough (50) at the shaker (52) of a drilling rig. Multiple suction lines (44) with corresponding multiple and cuttings suction inlet ports (30) may be utilized.

The cuttings exit port (34) of the centrifugal dryer (26) is integrally connected to a first cuttings collection chamber (36*a*) by means of an airtight passage way (35). The cuttings collection chamber (36*a*) has a sealable airtight exit door (37) in communication with a cuttings collection chamber dump valve (38). The exit door (37) and dump valve (38) allow cuttings to be removed from the first cuttings collection chamber (36*a*) to a second cuttings collection chamber (36*b*) that is integrally connected to the first cuttings collection chamber (36*a*). The second cuttings collection chamber (36*b*) has a sealable airtight exit door (39) in communication with a cuttings collection chamber dump valve (40). The dump valve (40) regulates removal of cuttings from the second cuttings collection chamber (36*b*) to a cuttings dump chute (41). The cutting dump chute (41) directs the gravity flow of dry cuttings from the cuttings collection chamber (36*b*) to a cuttings storage box (42) or other desired equipment. Because the exit doors (37, 39) are sealable and airtight, either one can be opened to allow movement cuttings without reducing the vacuum in the centrifugal dryer (26). Alternating the opening of exit doors (37, 39) will allow cuttings to drawn into the centrifugal dryer (26) while cuttings are exiting cuttings collection chamber (36*a*) or chamber (36*b*).

It can be seen that a single cuttings collection chamber in combination with a cuttings dump chute and dump valve might be utilized to deliver cuttings to the cuttings storage box (42). Similarly, a series of cuttings collection chambers and dump valves might be utilized in combination with a cuttings dump chute to deliver cuttings to a storage box (42).

It is thought that the cuttings dump valves (38, 40) will be a manual or automatically operable slide gate valves or knife edge gate valves though other types of valves such as a butterfly valve could be utilized. Slide gate valves or knife edge gate valves such as those manufactured by Salina Vortex Corporation, Global Headquarters, 1725 Vortex Avenue, Salina, Kans. 67401 or WEY Valve Inc., 3985 Hwy 6 North, Nettleton Miss., 38858 are thought suitable for the cuttings dump valves (38, 40).

The fluids collection chamber (54) is positioned between the vacuum tank (12) and the centrifugal dryer (26). Vacuum line (20*a*) extends from the vacuum port (32) of the centrifugal dryer (26) to vacuum port (56*a*) in the fluids collection chamber (54) and vacuum line (20*b*) extends from vacuum port (56*b*) in the fluids collection chamber (54) to the vacuum tank (12). The fluids collection chamber (54) collects the fluids from the cuttings that are drawn by vacuum from the centrifugal dry chamber (25) of the centrifugal dryer (26) and that exit the vacuum port (32) of the centrifugal dryer (26) into vacuum line (20*a*). An airtight fluids exit port (60) having an associated fluids dump valve (61) is provided in the fluids collection chamber (54). It is thought that the fluids dump valve (61) will be an automatic or manually operated valve such as a butterfly valve, a gate valve, or a ball valve.

The fluids exit port (60) is in communication with a fluids discharge line (62). A discharge outlet (64) from the discharge line (62) delivers any fluids discharged from the fluids collection chamber (54) in the discharge line (62) to a fluids holding tank (66) or other desired location.

The vacuum tank (12) may be provided with a vacuum control port (13) in communication with a vacuum control or relief valve (15). The vacuum relief valve (15) is used to regulate the vacuum created in the vacuum tank (12) and thus the vacuum created in the centrifugal dryer (26) and ultimately the suction created at the cuttings inlet suction port (30) of the centrifugal dryer (26).

Pressure monitors (29) may be positioned at desired locations through out the system such as in the vacuum tank (12), the fluids collection chamber (54), or the centrifugal dryer (26) to monitor and generate pressure signals (71). These pressure signals (71) may be delivered to a control panel (70) from which control signals (73*a*) may be transmitted to the vacuum control valve (15) to regulate the vacuum created in the vacuum tank (12).

The control panel (70) may also be used to transmit control signals (73*b*) to the cuttings dump valves (38, 40) at the exit doors (37, 39) of the cuttings collection chambers (36*a*, 36*b*) to regulate the flow of cuttings through the cuttings collection chambers and the removal of cuttings from the collection chambers to the cuttings dump chute (41). Similarly, the control panel (70) may also be used to transmit control signals (73*c*) to the fluids dump valve (61) at the fluids exit port (60) of the fluids collection chamber (54) to regulate removal of fluids from the fluids collection chamber (54).

In operation, as shown in FIG. 1 and FIG. 2, the apparatus is assembled as described above with one end of suction line (44) extending from the suction port (32) of the centrifugal dryer (26) to the cuttings collection trough (50) at the shaker (52). With the vacuum relief valve (15), the cuttings dump valve (40), and the fluids dump valve (61) closed, and the vacuum pump (14) and motor (16) in operation, a vacuum is created in the vacuum tank (12) and thus the centrifugal dryer (26). Drill cuttings are then drawn from the cuttings trough (50) at the shaker (52) through the suction line (44) and into the centrifugal drying chamber (25) of the centrifugal dryer (26) for drying.

Drill cuttings accumulated in the centrifugal dryer (26) are discharged by gravity means through the cuttings exit port (34) of the centrifugal dryer (26) to the first cuttings collection chamber (36*a*) via the airtight passage way (35). Drill cuttings from the cuttings collection chamber (36*a*) are then removed by gravity to the second cuttings collection chamber (36*b*) by opening exit door (37) by means of cuttings collection chamber dump valve (38). Cuttings from the second cuttings collection chamber (36*b*) are moved by gravity to the cuttings dump chute (41) through exit door (39) by opening exit door (39) by means of cuttings collection chamber dump valve (40). The cutting dump chute (41) then directs the gravity flow of dry cuttings to the cuttings storage box (42) or to other desired equipment. Exit door (37) and exit door (39) may be opened and closed in sequence in order to prevent the loss of vacuum in the centrifugal dryer (26) which would interrupt the flow of cuttings from the cuttings collection chamber (50) at the shaker (51).

Fluids drawn from the centrifugal dry chamber (25) of the centrifugal dryer (26) are suctioned through the vacuum port (32) into vacuum line (20*a*) where they are collected in the fluids collection chamber (54) positioned between the vacuum tank (12) and the centrifugal dryer (26). The accumulated fluids are removed from the fluids collection chamber (54) by opening the fluids dump valve (61) associated with the airtight fluids exit port (60) to deliver fluids to the fluids discharge line (62) and ultimately to the fluids holding tank (66) or other desired location for disposal or other treatment. These accumulated fluids may also be returned to the mud tank of the drilling rig for reuse.

The vacuum generated in the centrifugal dryer (26) of the apparatus 10 by means of the vacuum tank (12) is monitored by means of pressure monitors (29). The pressure monitors (29) then generate pressure signals (71) delivered to the control panel (70). The control panel (70) may then be used to generate signals to the manipulate the cuttings dump valves (38, 40), the vacuum relief valve (15) or fluids dump valve (61) as may be required in order to control the operation of the apparatus (10). The control panel (70) may be manually monitored and operated to generate the control signals or computer means may be utilized to receive pressure signals and generate control signals (73*a*, 73*b*, 73*c*) as required, either wirelessly or by hard wiring.

The components of the system may be easily transported to and from a well location by trucking or other means. The components may be arranged and mounted on a skid or skids to facilitate transportation of the system.

It is thought that the material handling system presented herein and many of its attendant advantages will be understood from the foregoing description. It is also thought that it will be apparent that various changes may be make in the form, construction and arrangement of the parts the system without departing from the spirit and scope of the invention or sacrificing all of its material advantages.

I claim:

1. A drill cuttings handling and dryer apparatus comprising:

(a) a vacuum tank, said vacuum tank having an associated vacuum pump and motor;

(b) a centrifugal dryer, said centrifugal dryer having a screened centrifugal drying chamber, a cuttings inlet suction port in communication with said drying chamber, a dryer vacuum port; and a cuttings exit port;

(c) a vacuum line extending from said vacuum tank to said dryer vacuum port of said centrifugal dryer;

(d) a suction line in communication with said cuttings inlet suction port;

(e) a first cuttings collection chamber integrally connected to said cuttings exit port of said centrifugal dryer;

(f) a first airtight cuttings exit door; and (g) a first cuttings dump valve whereby said first airtight cuttings exit door is opened and closed.

2. The apparatus as recited in claim 1, further comprising:

(a) a second cuttings collection chamber integrally connected to said first cuttings collection chamber at said first airtight cuttings exit door, said second cuttings collection chamber having a second airtight cuttings exit door; and (b) a second cuttings dump valve whereby said second airtight cuttings exit door is opened and closed.

3. The apparatus as recited in claim 2, further comprising:

(a) a fluids collection chamber having first and second vacuum ports and an airtight fluids exit port, said fluids collection chamber positioned between said vacuum tank and said centrifugal dryer whereby said vacuum line extends from said vacuum port of said centrifugal dryer to said first vacuum port in said fluids collection chamber and from said second vacuum port in said fluids collection chamber to said vacuum tank; and (b) a fluids dump valve for opening and closing said fluids exit port.

4. The apparatus as recited in claim 3, further comprising a fluids discharge line in communication with said fluids exit port.

5. The apparatus as recited in claim 4, wherein said suction line in communication with said cuttings inlet suction port extends to a cuttings collection trough at a shaker of a drilling rig.

6. The apparatus as recited in claim 5, further comprising a vacuum relief valve positioned on said vacuum tank, said vacuum relief valve in communication with vacuum control port in said vacuum tank.

7. The apparatus as recited in claim 6, further comprising a control panel, said control panel receiving and generating control signals to and from said vacuum relief valve, said fluids dump valve, and said first and second cuttings dump valves.

8. The apparatus as recited in claim 7, wherein pressure monitors are positioned in said vacuum tank, said fluids collection tank, and said centrifugal dryer, said pressure monitors generating pressure signals to said control panel.

9. A drill cuttings handling and dryer apparatus comprising:

(a) a vacuum tank, said vacuum tank having an associated vacuum pump and motor;

(b) a centrifugal dryer, said centrifugal dryer having a screened centrifugal drying chamber, a cuttings inlet suction port in communication with said drying chamber, a dryer vacuum port; and a cuttings exit port;

(c) a fluids collection chamber, said fluids collection chamber having a fluids exit port and an airtight fluids dump valve in communication with said fluids exit port;

(d) a vacuum line extending from said vacuum tank to said fluids collection chamber;

(e) a vacuum line extending from said fluids collection chamber to said dryer vacuum port of said centrifugal dryer;

(f) a suction line in communication with said cuttings inlet suction port; and (g) a plurality of interconnected cuttings collection chambers all in communication with said cuttings exit port of said centrifugal dryer, each of said cuttings collection chambers having an airtight cuttings dump valve.

10. The apparatus as recited in claim 9, further comprising:

(a) a vacuum relief valve positioned on said vacuum tank, said vacuum relief valve in communication with vacuum control port in said vacuum tank; and (b) a control panel, said control panel receiving and generating control signals to and from said vacuum relief valve, said fluids dump valve, and said plurality of cuttings dump valves.

11. The apparatus as recited in claim 10, wherein pressure monitors are positioned in said vacuum tank, said fluids collection tank, and said centrifugal dryer, said pressure monitors generating pressure signals to said control panel.

12. The apparatus as recited in claim 9, wherein said suction line in communication with said cuttings inlet suction port extends to a cuttings collection trough at the shaker of a drilling rig.

13. A method of handling and drying drill cuttings comprising the steps of:

(a) providing a drying apparatus, said drying apparatus comprising (i) a vacuum tank, said vacuum tank having an associated vacuum pump and motor; (ii) a centrifugal dryer, said centrifugal dryer having a screened centrifugal drying chamber, a cuttings inlet suction port in communication with said drying chamber, a dryer vacuum port; and a cuttings exit port; (iii) a fluids collection chamber, said fluids collection chamber having a fluids exit port and an airtight fluids dump valve in communication with said fluids exit port; (iv) a vacuum line extending from said vacuum tank to said fluids collection chamber; (v) a vacuum line extending from said fluids collection chamber to said dryer vacuum port of said centrifugal dryer; (vi) a suction line in communication with said cuttings inlet suction port; and (vii) a plurality of interconnected cuttings collection chambers all in communication with said cuttings exit port of said centrifugal dryer, each of said cuttings collection chambers having an airtight cuttings dump valve;

(b) extending said suction line of said drying apparatus to a cuttings collection trough at the shaker of a drilling rig;

(c) creating a vacuum in said vacuum tank of said drying apparatus whereby drill cuttings from said cuttings collection trough are drawn through said suction line into said screened centrifugal drying chamber whereby fluids are drawn from said drill cuttings in said drying chamber;

(d) transporting said fluids drawn from said drillings cuttings through said vacuum line extending from said dryer vacuum port of said centrifugal dryer to said fluids collection chamber; and (e) moving said drill cuttings through said plurality of interconnected cuttings collection chambers by opening and closing said airtight cuttings dump valves.

14. The method as recited in claim 13, comprising the additional steps of:

(a) providing a vacuum relief valve positioned on said vacuum tank, said vacuum relief valve in communication with vacuum control port in said vacuum tank;

(b) providing a control panel, said control panel receiving and generating control signals to and from said vacuum relief valve, said fluids dump valve, and said plurality of cuttings dump valves;

(c) controlling the flow of cuttings into said drying apparatus by generating opening and closing signals from said control panel to said vacuum relief valve;

(d) controlling the removal of fluids from said fluids collection chamber by generating opening and closing signals from said control panel to said fluids dump valve; and (e) controlling the flow and removal of cuttings from said centrifugal dryer by generating opening and closing signals from said control panel to said plurality of cuttings dump valves.

15. The method as recited in claim 14, wherein said cuttings dump valves are opened and closed in a sequence to allow removal of said cuttings from said cuttings collection chambers whereby a vacuum is maintained in said centrifugal dryer so as to allow cuttings to be drawn into said centrifugal dryer through said suction line.

* * * * *